US008980511B2

(12) United States Patent
Zhou et al.

(10) Patent No.: US 8,980,511 B2
(45) Date of Patent: Mar. 17, 2015

(54) ORGANIC PHOTOCONDUCTOR COATING

(71) Applicant: Hewlett-Packard Development Company, L.P., Houston, TX (US)

(72) Inventors: Zhang-Lin Zhou, Palo Alto, CA (US); Krzysztof Nauka, Palo Alto, CA (US); Lihua Zhao, Sunnyvale, CA (US); Anthony William McLennan, Concord, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 37 days.

(21) Appl. No.: 13/672,503

(22) Filed: Nov. 8, 2012

(65) Prior Publication Data

US 2014/0127617 A1 May 8, 2014

(51) Int. Cl.

| | |
|---|---|
| ***G03G 5/14*** | (2006.01) |
| ***G03G 5/147*** | (2006.01) |
| ***G03G 5/05*** | (2006.01) |
| ***G03G 5/06*** | (2006.01) |

(52) U.S. Cl.

CPC ..... *G03G 5/14734* (2013.01); *G03G 5/0546* (2013.01); *G03G 5/0578* (2013.01); *G03G 5/0592* (2013.01); *G03G 5/0605* (2013.01); *G03G 5/14708* (2013.01); *G03G 5/14773* (2013.01); *G03G 5/14791* (2013.01)

USPC ..... 430/66; 430/132

(58) Field of Classification Search

CPC ..... G03G 5/147; G03G 5/14713; G03G 5/14734; G03G 5/14786; G03G 5/14791

USPC ..... 430/66

See application file for complete search history.

(56) References Cited

U.S. PATENT DOCUMENTS

| | | | | |
|---|---|---|---|---|
| 4,565,760 | A | 1/1986 | Schank et al. | |
| 4,600,673 | A | 7/1986 | Hendrickson et al. | |
| 6,939,651 | B2 | 9/2005 | Li et al. | |
| 7,700,248 | B2 | 4/2010 | Jin et al. | |
| 7,846,629 | B2 | 12/2010 | Yanus et al. | |
| 2008/0124640 | A1 * | 5/2008 | Wu et al. | 430/58.8 |
| 2008/0227008 | A1 * | 9/2008 | Kami et al. | 430/66 |
| 2011/0053066 | A1 * | 3/2011 | Wu et al. | 430/58.8 |

FOREIGN PATENT DOCUMENTS

| | | | |
|---|---|---|---|
| JP | 2012-198278 | * 10/2012 | G03G 5/147 |

OTHER PUBLICATIONS

Translation of JP 2012-198278 published Oct. 2012.*

* cited by examiner

*Primary Examiner* — Peter Vajda

(57) ABSTRACT

An organic photoconductor includes a conductive substrate; a charge generation layer over the conductive substrate; a charge transport layer over the charge generation layer; and an overcoat layer over the charge transport layer. The overcoat layer comprises a cross-linked polyacrylate that includes a charge transport material dispersed therein and a polyhedral oligomeric silsesquioxane.

20 Claims, 5 Drawing Sheets

ORGANIC PHOTOCONDUCTOR COATING

BACKGROUND

An organic photoconductor (OPC) is one of the components in an electrophotographic (EP) printer. A latent image, which is a surface charge pattern, is created on the OPC prior to contact with a development system containing charged marking particles. This is accomplished by uniformly charging the OPC surface, followed by selective illumination that locally generates opposite charges which then move to the surface and locally neutralize deposited charges. The OPC frequently has two layers: an inner layer for generating charges (charge generation layer—CGL) and an outer layer containing molecular moieties for facilitating charge movement (charge transport layer—CTL). The OPC element may have a very uniform and defect free structural and electrical characteristics. Its usable lifetime is often determined by the occurrence of physical defects introduced by mechanical, physicochemical and electrical interactions between the surface of the CTL and one or more elements of the electrophotographic process (commonly known as "OPC wear-out"). Some of the proposed solutions addressing this issue involve coating the CTL surface with a hard, inorganic film that may significantly raise the OPC cost and introduce other deleterious effects associated with the contamination particles originating from the inorganic coating.

Alternative solutions have proposed coating the OPC with an organic coating having superior damage resistance and electrical properties corresponding to the original OPC. This might be accomplished by using a mixture of damage-resistant polymer (matrix) and molecular moieties (CTM—charge transport material) providing electrical charge conduction, and coating the original OPC with their solvent-based mixture.

DETAILED DESCRIPTION

Figure 1:
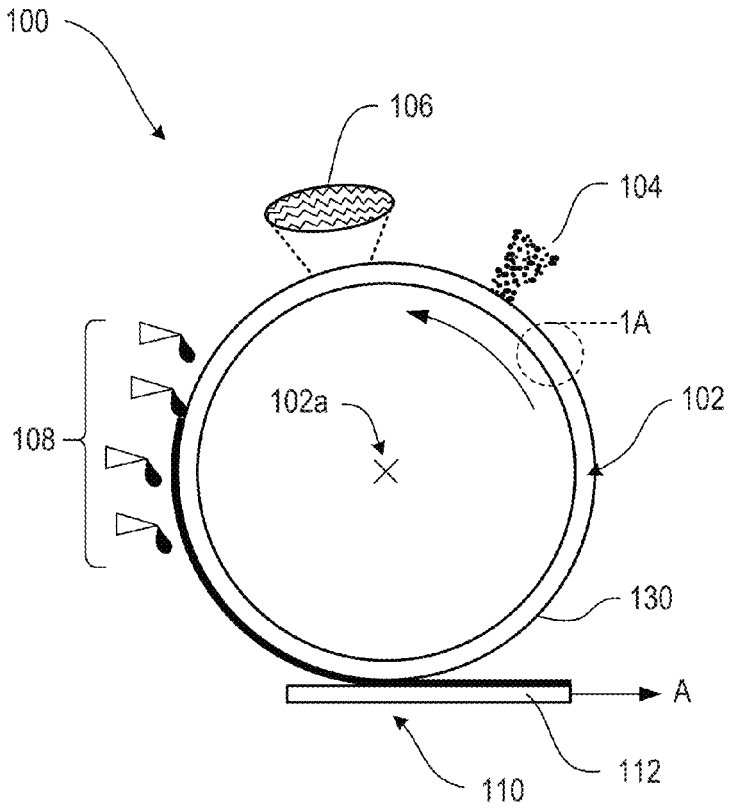
FIG. 1 is a schematic diagram of an apparatus that employs an example organic photoconductor (OPC) drum, in accordance with the teachings herein.

Reference is made now in detail to specific examples, which illustrates the best mode presently contemplated by the inventors for practicing the invention. Alternative examples are also briefly described as applicable.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "about" means a ±10% variance caused by, for example, variations in manufacturing processes.

As used herein, "alkyl" refers to a branched, unbranched, or cyclic saturated hydrocarbon group, which typically, although not necessarily, includes from 1 to 50 carbon atoms, or 1 to 30 carbon atoms, or 1 to 6 carbons, for example. Alkyls include, but are not limited to, methyl, ethyl, n-propyl, isopropyl, n-butyl, isobutyl, t-butyl, octyl, and decyl, for example, as well as cycloalkyl groups such as cyclopentyl, and cyclohexyl, for example.

As used herein, "aryl" refers to a group including a single aromatic ring or multiple aromatic rings that are fused together, directly linked, or indirectly linked (such that the different aromatic rings are bound to a common group such as a methylene or ethylene moiety). Aryl groups described herein may include, but are not limited to, from 5 to about 50 carbon atoms, or 5 to about 40 carbon atoms, or 5 to 30 carbon atoms or more. Aryl groups include, for example, phenyl, naphthyl, anthryl, phenanthryl, biphenyl, diphenylether, diphenylamine, and benzophenone. The term "substituted aryl" refers to an aryl group comprising one or more substituent groups. The term "heteroaryl" refers to an aryl group in which at least one carbon atom is replaced with a heteroatom. If not otherwise indicated, the term "aryl" includes unsubstituted aryl, substituted aryl, and heteroaryl.

As used herein, "substituted" means that a hydrogen atom of a compound or moiety is replaced by another atom such as a carbon atom or a heteroatom, which is part of a group referred to as a substituent. Substituents include, but are not limited to, for example, alkyl, alkoxy, aryl, aryloxy, alkenyl, alkenoxy, alkynyl, alkynoxy, thioalkyl, thioalkenyl, thioalkynyl, and thioaryl.

The terms "halo" and "halogen" refer to a fluoro, chloro, bromo, or iodo substituent.

As used herein, "alcohol" means a lower alkyl chain alcohol, such as methanol, ethanol, n-propanol, iso-propanol, n-butanol, iso-butanol, tert-butanol, pentanol, hexanol, and their analogs.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

The organic photoconductor (OPC) in an electrophotographic printer is a thin film photoconductive layer. An electrostatic latent image is formed on the pre-charged photoreceptor surface via image-wise optical exposure. A visual image is obtained after the electrostatic image is developed with charged color toner particles that are subsequently transferred to paper and the corona charged with ions to get ready for the next imaging process.

In the electrophotographic process, the photoreceptor (web or cylinder) is required to have very uniform area characteristics: coating uniformity, dark conductivity, and photoconductivity. During each imaging cycle, the OPC surface is subjected to a number of punishing electrochemical and mechanical processes. They include corrosive ozone and acid treatments from corona charging, abrasive mechanical treatments from toner development, and toner transfer to paper and doctor blade cleaning. They may cause removal of the top part of CTL or mechanical damage (scratching) and local cracking of the CTL. In the case of liquid electrophotography (such as used in HP Indigo presses), these processes can be further enhanced by interactions between the solvent (usually a non-polar, ISOPAR®-based mixture) and the polymer constituting the CTL layer. There may be interactions with the intermediate transfer medium, in the case of LEP printing process. Also, the CTL may be subjected to abrasive polishing (from a polishing unit) with a polishing cloth, again in the LEP technology. Damage to the CTL can degrade print quality. Frequent photoconductor replacement has a deleterious impact on the cost of the printing process, which is particularly important for high speed/large volume printing applications (as in the case of HP Indigo digital presses).

An example of an electrophotographic (EP) printer that may employ an organic photoconductor (OPC) is depicted in FIG. 1, which is a schematic diagram of portion of a generic EP printer. The illustrative example of FIG. 1 depicts a liquid EP printer. It will be understood that examples herein might be implemented in any type of EP printers such as, but not limited to, a dry toner EP printer.

An EP printer 100 comprises an OPC drum 102 that is rotatable about an axis 102*a*. The construction of the OPC drum 102, which incorporates the teachings herein, is described in greater detail below.

As the OPC drum 102 rotates, it passes through several stations, including a charging station 104, an exposure station 106, a development station 108, and a transfer station 110.

At the charging station 104, an electrostatic charge is uniformly distributed over the surface of the OPC drum 102. Charging is typically done by a corona or a charge roller.

At the exposure station 106, also known as the image-forming station, the document to be printed or its image formed on a screen is illuminated and either passed over a lens or is scanned by a moving light and lens, such that its image is projected onto and synchronized with the moving drum surface. Where there is text or image on the document, the corresponding area of the drum becomes lit. Where there is no image, the drum is not illuminated. The charge that remains on the drum after this exposure is a "latent" image and is a negative of the original document.

At the development station 108, the drum 102 is presented with toner, e.g., liquid toner, more specifically, black ink in the case of a black ink-only printer and colored inks in the case of a color ink printer. The liquid toner is electrically charged and attracted to areas on the drum bearing complementary electrical charges.

At the transfer station 110, the ink on the drum 102 is transferred to a print medium 112 either directly or through an intermediate transfer medium, moving in the direction indicated by arrow A.

Following ink transfer, the drum 102 is prepared for a new imaging cycle.

Figure 1A:
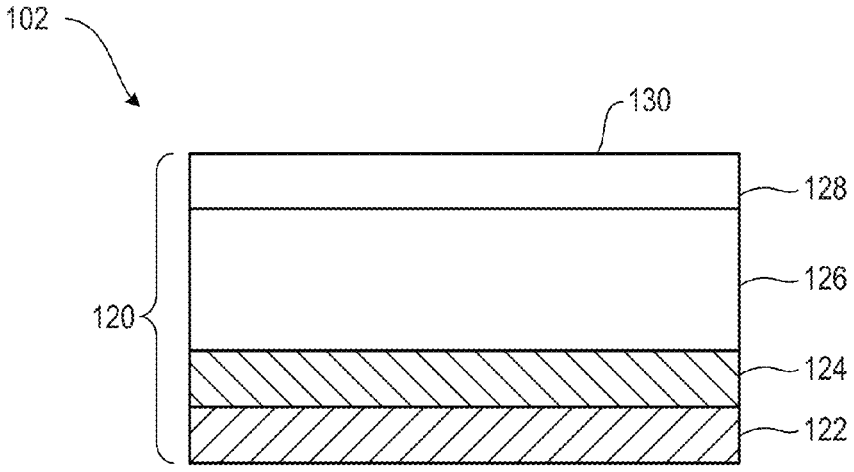
FIG. 1A is an enlargement of a portion of the OPC drum of FIG. 1.

FIG. 1A is an enlargement of a portion of the drum 102 of FIG. 1, and depicts an example configuration in accordance with the teachings herein. An OPC 120 may comprise a conductive substrate 122, a charge generation layer (CGL) 124, and a charge transport layer (CTL) 126. The thickness of the CTL 126 may be greater than 10 μm. A CTM-doped protective coating (DPC) 128 may be formed over the exterior surface of the CTL 126. While each layer may be formed "on" the layer below, there may be one or more intermediate layers provided. Such intermediate layers do not alter the basic structure of the conductive substrate 122, the CGL 124, the CTL 126, and the DPC 128, but may serve to augment these layers 122, 124, 126, 128. The term "over" is intended to include both "directly on" and separation by one or more intermediate layers.

In essence, the organic photoconductor commonly used in electrophoto-graphic applications is a dual layer structure consisting of a relatively thin (for example, 0.1 to 2 μm) bottom layer (CGL) and a relatively thick (for example, about 20 μm) top layer (CTL). Light passes through the transparent CTL and strikes the CGL that generates free electrons and holes. Electrons are collected by the electrical ground of the photoreceptor and holes are driven towards the top of the CTL by the applied electrical field. The CTL provides a mechanism for holes transporting towards the surface, where they are used to neutralize negative surface ions deposited during the pre-charging process.

The CTL may consist of non-conductive organic material (usually a polymer) with charge transport moieties embedded in it. In most cases, the CTL may be made of a non-conductive polycarbonate matrix having charge transport moieties in form of conductive organic small molecules or short chain polymers, such as aryl hydrazones, aminoaryl heterocycles such as oxadiazole, and, in some examples, highly conjugated arylamines.

The organic photoconductor (OPC) in an electrophotographic printer is a thin film photoconductive layer. An electrostatic latent image is formed on the pre-charged photoreceptor surface via image-wise optical exposure. A visual image is obtained after the electrostatic image is developed with charged color toner particles that are subsequently transferred to paper. After the toner is transferred to paper, the photoreceptor needs to be cleaned and the corona charged with ions to get ready for the next imaging process. In the electrophotographic process, the photoreceptor (web or cylinder) is required to have very uniform area characteristics: coating uniformity, dark conductivity, and photoconductivity. During each imaging cycle, the OPC surface is subjected to a number of punishing electrochemical and mechanical processes. They include corrosive ozone and acid treatments from corona charging, abrasive mechanical treatments from toner development, and toner transfer to paper and doctor blade cleaning. They may cause removal of the top part of CTL or mechanical damage (scratching) and local cracking of the CTL. In the case of liquid electrophotography (used in HP Indigo presses), these processes can be further enhanced by interactions between the solvent (usually a non-polar, ISOPAR®-based mixture) and the polymer constituting the CTL layer. Damage to the CTL can degrade print quality. Frequent photoconductor replacement has a deleterious impact on the cost of the printing process, which is particularly important for high speed/large volume printing applications (as in the case of HP Indigo presses).

The structure of the organic photoreceptor usually has several layers of materials, each of which performs a specific function, such as charge generation, charge transport, and occasionally additional surface protection. These layers are formed by individual sequential coatings. One of these layers is the charge transport material (CTM) layer, or CTL 126. In this regard, mainly aromatic tertiary amino compounds and their corresponding polymers are usually used. Generally, these materials are soluble in common organic solvents such as tetrahydrofuran (THF) and dichloromethane ($CH_2Cl_2$). Because of their solubility in these solvents, there is usually a loss of charge transport material and/or mixing with the material that is over-coated on top for protection. In addition, these materials cannot facilitate "fast" transport of electrical charges, making them less desirable for the high-speed printing applications, such as digital commercial printing.

In the electrophotographic process, the photoreceptor (belt or cylinder) ideally has very uniform area characteristics: coating uniformity, dark conductivity, and photoconductivity. During each imaging cycle, the OPC surface is subjected to a number of punishing electrochemical and mechanical processes. These include corrosive ozone and oxidative reactions from corona or charge roller charging, abrasive mechanical treatments from toner development, toner transfer to paper, and doctor blade cleaning of the drum and contact with a charge roller. The essential physical properties that dictate the electrophotographic imaging process, such as dark and photo conductivity and electronic defects on the photoreceptor surface etc. would definitely accelerate their deterioration under such detrimental conditions. Therefore, it is desirable to develop protective overcoats for the OPCS.

In the case of liquid electrophotography (LEP), these processes can be further enhanced by interactions between the solvent (usually a non-polar, isoparaffinic-based mixture) and the polymer constituting the CTL. In many cases, solvent can penetrate into the CTL through openings caused by the mechanically damaged surface and can cause local swelling of the CTL. The CTL damage degrades print quality, resulting in frequent replacement of the OPC. Mechanical damage of the OPC can be related to a relatively high concentration of the molecular conducting moieties (small molecules) that in some cases can be as high as 50% of the CTL volume. Frequent photoconductor replacement can have a negative impact on the cost of the printing process, which is particularly important for high speed/large volume printing applications, as in the case of digital commercial printers.

Previous attempts to improve the operational lifetime of the OPC surface region have relied on coating it with a layer of a "hard" inorganic film, such as carbon (e.g., graphite or diamond), silica, etc. This solution is not popular due to the following reasons: a) difficulties in forming such inorganic film on the organic substrate (lack of compatible deposition processes); b) excessively high cost of the inorganic films and their poor reliability; and c) "dust" issues due to the fact that the inorganic coating may "shed" microscopic particles caused by the mechanical interactions with the print engine components and poor adhesion of the inorganic coating to an organic substrate.

On the other hand, the promising results of using organic solvent-based cross-linkable coatings with CTMs to extend the lifetime of OPC have been demonstrated. Their advantage stems from the fact that, due to their superior electrical conductivity, the desired electrical properties of the coating can be achieved at low CTM concentrations without compromising mechanical strength of the layer. However, most of the CTMs can only be dissolved into more aggressive solvents such as toluene, xylenes, THF, chloroform, chlorobenzene, and dichlorobenzene, etc. Unfortunately, all of these solvents can damage the existing CTL 126 in a commercial OPC. Polycarbonates used in the CTL 126 can survive only a few solvents such as water and alcohols, while essentially all of the commercially-available CTMs have very poor solubility in water and alcohols. Thus, the development of water-soluble CTMs could permit a solution process to coat the OPC layer without damaging the polycarbonate layer.

More recent solutions have provided the charge transport layer of the OPC with a subsequently cross-linkable thin film that can significantly increase the OPC time-to-failure without degrading its printing performance. This improvement of the OPC lifetime is due to increased scratch resistance of the OPC coating as compared to scratch resistance of the original uncoated OPC.

These recent solutions include employing alcohol-soluble hole transport materials and coating the CTL 126 of the OPC with a solvent-based mixture containing monomer moieties which are cross-linked after deposition on the OPC. That is to say, the monomer is cross-linked in-situ on the surface of the OPC to provide the protective coating 128. This approach provides much better adhesion and higher mechanical strength layers than in the case where a previously cross-linked polymer is deposited on the OPC.

In this process, the respective liquid solvent mixture of monomers, oligomers or even polymers, mixed with uniformly distributed charge transfer species, may be used, followed by deposition of the mixture on the photoconductor and, finally, cross-linking of the polymerizable species. The resulting product is a thin protective layer, fully mechanically conformal with the photoconductor and containing uniformly distributed charge transfer moieties. In another example, this process can be used to the entire CTL region—in this case, a thin solvent mixture layer may be deposited on the CGL film. Deposition process can be further controlled by using appropriate surfactants improving wetting of the deposition substrate.

In accordance with the teachings herein, a novel cross-linkable system is provided that may be mixed with suitable charge transport materials (CTMs) that can be used for an alcohol-based solution OPC coating process to provide the CTM-doped protective coating (DPC) 128 on the exterior surface of the CTL 126. The cross-linkable system may be based on polyhedral oligomeric silsesquioxanes (POSS) based cross-linkers.

Due to its true and intrinsic hybrid character and versatile choices of organic groups R that are covalently bonded with its inorganic core, the POSS-based OPC overcoat formulation offers several advantages: (a) the formulation avoids the use of expensive fluorinated alcohols that may be required to dissolve matrix components, which may cause the damages of the existing OPC surfaces; (b) the film based on POSS cross-linkers has excellent chemical stability and is stable against a wide range of chemicals; (c) the film has excellent mechanical strength against scratch; and (d) the film has very strong water resistance and does not swell when in contact with the isoparaffinic solvent used in printing processes.

POSS is an acronym for Polyhedral Oligomeric Silsesquioxanes. An oligomeric silsesquioxane is a molecule of which the repeating unit has the formula $RSiO_{3/2}$. The term "silsesqui" refers to the ratio of the silicon and oxygen atoms, i.e. Si:O=1:1.5. An oligomeric silsesquioxane can have different molecular architecture such as random structure, ladder-like structure, cage structure and partial cage structure. Generally, the term POSS indicates the oligomeric silsesquioxanes with a cage structure, which has the general formula $(RSiO_{3/2})n$, where R denotes various hydrocarbons and n=6 to 18. The term "polyhedral" derives from the precise geometry of the POSS cage, which strongly resembles a polyhedron. The number of silicon atoms on each POSS molecules, which is usually 8, is not the only parameter characterizing the different POSS compounds. In fact, an important parameter may be the type of organic groups R that the POSS molecules bear. The most general chemical structure of an 8 silicon—POSS cubic cage, has the formula $(SiO_{3/2})_8R_nX_{8-n}$.

The size of a POSS molecule is between classical organic monomers (about 1 to 10 Å) and macromolecules (about 10 to 100 nm), which is at least order smaller than smallest silica object available. Also, the POSS is monodisperse in size, while silica is notoriously polydisperse. POSS possesses a true and intrinsic hybrid character. While the inorganic Si—O core ensures some properties such as good thermal degradation resistance, POSS could be compatible with the organic media, both solvents and polymers without the need for surface treatment. The organic groups on the POSS can be selected among a wide array of organic and hybrid chemical species. The choice of the compatibilizing groups R allows the tailoring of the POSS miscibility inside the organic media, from full miscibility (even down to molecular level) to partial segregation at a nanometer scale to full immiscibility (phase segregation-separation at a micrometer scale).

The general structure for polyhedral silsesquioxane (POSS) is

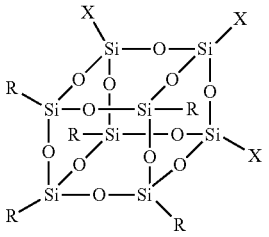

wherein R generally indicates unreactive organic groups for solubilization and compatibilization of the POSS molecules with organic media, while X indicates reactive groups for grafting polymerization. These R and X groups can be tailored with the synthetic chemistry tools available, and presently, a very wide array of chemical groups can be bonded to the inorganic core, both as R and as X, thus giving rise to the possibility of using the POSS as inorganic core is the major portion in the finished polymeric system. For example, R can be alkyl, cycloalkyl, or aryl, such as methyl, ethyl, propyl, iso-propyl, butyl, sec-butyl, tert-butyl, pentyl, hexyl, cyclopropyl, cyclobutyl, cyclopentyl, cyclohexyl, cyclopentyl, phenyl, substituted phenyl, benzyl, substituted benzyl, etc. X can be any polymerizable functional group, such as a vinyl, an acrylate or methacrylate, an epoxy, a trialkoxysilane or trichlorosilane, an isocyanate, and so on. However, X may not be hydroxyl; this would give rise to a silanol-POSS, and any unreacted silanol on the surface of the overcoat layers or within their matrix may have a negative effect on the performance of the OPC.

Several different POSS nanostructured chemicals have been prepared. Such chemicals contain one or more covalently-bonded reactive functionalities that are suitable for polymerization, grafting, surface bonding, or other transformations. Unlike traditional organic compounds, POSS chemicals release no volatile organic components, so they are odorless and environmentally friendly. A large number of POSS-based monomers and cross-linkers have recently become commercially available as solids or oils from Hybrid Plastics Company. A selection of POSS chemicals now exist that contain various combinations of nonreactive substituents and/or reactive functionalities. Thus, POSS nanostructured chemicals may be easily incorporated into a common overcoat via copolymerization, grafting, or blending.

Broadly speaking, the concentration ranges used in the dispersion mixture to form the POSS-containing polymer overcoat layer 128 may be as follows:

1 to 20 wt % polyhedral silsesquioxane (POSS);
1 to 20 wt % co-monomer;
1 to 15 wt % cross-linking agent;
0.1 to 5 wt % initiator;
0 to 10 wt % surfactant;
0.1 to 5 wt % charge transport material; and
the balance an alcohol or a mixture of different alcohols.

The total concentration of all components in the dispersion mixture is 100 wt %. The various components are described in greater detail below.

Polyhedral Silsesquioxane (POSS)

The incorporation of POSS derivatives into polymeric materials can lead to dramatic improvements in polymer properties which include, but are not limited to, increases in use temperature, oxidation resistance, surface hardening, and improved mechanical properties, as well as reductions in flammability, heat evolution, and viscosity during processing. For example, POSS acrylate and methacrylate monomers are suitable for ultraviolet (UV) curing. High functionality POSS acrylates and methacrylates (for example, MA0735 and MA0736) are miscible with most of the UV-curable acrylic and urethane acrylic monomers or oligomers to form mechanically-durable hardcoats in which POSS molecules form nano-phases uniformly dispersed in the organic coating matrix. Reactive monomers based on POSS® chemical from Hybrid Plastic can be used for this application such as, but not limited to, EP0402-Epoxycyclohexylisobutyl POSS®, EP0408-Epoxycyclohexyl POSS® Cage Mixture, EP0409-Glycidyl POSS® Cage Mixture, EP0417-Glycidylethyl POSS®, EP0418-Glycidylisobutyl POSS®, EP0419-Glycidylisooctyl POSS®, EP0421-Triglycidylcyclohexyl POSS®, EP0423-Triglycidylisobutyl POSS®, EP0430-Octaepoxycyclohexyldimethylsilyl POSS®, EP0435-Octaglycidyldimethylsilyl POSS®, MA0701-Acryloisobutyl POSS®, MA0702-Methacrylisobutyl POSS®, MA0703-Methacrylatecyclohexyl POSS®, MA0706-Methacrylateisobutyl POSS®, MA0716-Methacrylateethyl POSS®, MA0717-Methacrylethyl POSS®, MA0718-Methacrylateisooctyl POSS®, MA0719-Methacrylisooctyl POSS®, MA0734-Methacrylphenyl POSS®, MA0735-Methacryl POSS® Cage Mixture, MA0736-Acrylo POSS® Cage Mixture, OL1118-Allylisobutyl POSS®, OL1123-Monovinylisobutyl POSS®, OL1159-Octacyclohexenyldimethylsilyl POSS®, OL1160-Octavinyl POSS®, OL1163-Octavinyldimethylsilyl POSS®, and OL1170-Octavinyl POSS® Cage Mixture.

It will be appreciated that when talking about the foregoing chemicals from Hybrid Plastic (Hattiesburg, Miss.), then the trademark POSS® chemicals will be used. When discussing the general polyhedral oligomeric silsesquioxanes, then the acronym POSS (without the trademark designation) will be used.

Co-monomer(s)

Co-monomers that can be used together with POSS cross-linkers include the monomeric or oligomeric(meth)acrylate or multi(meth)acrylate. The term "(meth)acrylate" is used to designate esters of acrylic and methacrylic acids, and "multi (meth)acrylate" designates a molecule containing more than one (meth)acrylate group, as opposed to "poly(meth)acrylate" which commonly designates (meth)acrylate polymers. Most often, the multi(meth)acrylate is a di(meth)acrylate, but it is also contemplated to employ tri(meth)acrylates, tetra (meth)acrylates and so on. Suitable monomeric or oligomeric (meth)acrylates include, but are not limited to, alkyl(meth) acrylates such as methyl(meth)acrylate, ethyl(meth)acrylate, 1-propyl(meth)acrylate, and t-butyl(meth)acrylate. The acrylates may include (fluoro)alkylester monomers of (meth)

acrylic acid, the monomers being partially or fully fluorinated (e.g., trifluoroethyl(meth)acrylate). Oligomeric urethane multi(meth)acrylates are commercially available, for example, from Sartomer (Exton, Pa.), under the trade designation "PHOTOMER 6000 Series" (e.g., "PHOTOMER 6010" and "PHOTOMER 6020"), and "CN 900 Series" (e.g., "CN966B85", "CN964", and "CN972"). Oligomeric urethane(meth)acrylates are also available, for example from Cytec Industries Inc. (Woodland Park, N.J.), under the trade designations "EBECRYL 8402", "EBECRYL 8807" and "EBECRYL 4827". Oligomeric urethane(meth)acrylates may also be prepared by the initial reaction of an alkylene or aromatic diisocyanate of the formula OCN—R3-NCO with a polyol. Most often, the polyol may be a diol of the formula HO—R4-OH where R3 is a C2 to C100 alkylene or an arylene group and R4 is a C2 to C100 alkylene group. The intermediate product is then a urethane diol diisocyanate, which subsequently can undergo reaction with a hydroxyalkyl (meth)acrylate. Suitable diisocyanates include 2,2,4-trimethylhexylene diisocyanate and toluene diisocyanate. In some examples, alkylene diisocyanates may be used. Other examples of compounds of this type may be prepared from 2,2,4-trimethylhexylene diisocyanate, poly(caprolactone) diol, and 2-hydroxyethyl methacrylate. In at least some examples, the urethane(meth)acrylate may be aliphatic.

The other monomers may also be a monomeric N-substituted or N,N-disubstituted(meth)acrylamide, such as an acrylamide. These include N-alkylacrylamides and N,N-dialkylacrylamides, such as those containing C1 to C4 alkyl groups. Examples include, but are not limited to, N-isopropylacrylamide, N-t-butylacrylamide, N,N-dimethylacrylamide and N,N-diethylacrylamide. The other monomers may further be a polyol multi(meth)acrylate. Such compounds may be typically prepared from aliphatic diols, triols, and/or tetraols containing 2 to 10 carbon atoms. Examples of suitable poly (meth)acrylates include, but are not limited to, ethylene glycol diacrylate, 1,6-hexanediol diacrylate, 2-ethyl-2-hydroxymethyl-1,3-propanediol triacylate (trimethylolpropane triacrylate), di(trimethylolpropane)tetraacrylate, pentaerythritol tetraacrylate, the corresponding methacrylates and the (meth)acrylates of alkoxylated (usually ethoxylated) derivatives of said polyols. Monomers having two or more ethylenically unsaturated groups can serve as a crosslinker. Styrenic compounds suitable for use as the other monomer include styrene, dichlorostyrene, 2,4,6-trichlorostyrene, 2,4,6-tribromostyrene, 4-methylstyrene, and 4-phenoxystyrene. Ethylenically unsaturated nitrogen heterocycles include N-vinylpyrrolidone and vinylpyridine.

In one example, co-monomers also include the linear aliphatic acrylate, branched aliphatic acrylate, or cyclic aliphatic acrylate and can include, but is not limited to, ethyl, propyl, isobutyl, butyl, tertarylbutyl, pentyl, hexyl, heptyl, octyl, nonyl, decyl, dodecyl, octadecyl, 2-ethylhexyl, lauryl, cyclohexyl, and butylcyclohexyl acrylates. Blends of these monomers with heteroatom containing functional monomers can also be used to enhance and fine tune a desire latex property. These monomers can include, but are not limited to, 2-hydroxylethyl, 2-hydroxylpropyl, 2-hydroxylbutyl, dimethylaminoethyl, glycidyl, butanediol, 2-carboxylethyl, 2-ethoxyethyl, di(ethylene glycol) methyl ether, ethylene glycol methyl ether, ethylene glycol phenyl ether, 2-(4-benzoyl-3-hydroxyphenoxy)ethyl, 2-(dialkylamino)ethyl, 2-(dialkylamino)propyl, 2-[[(butylamino)carbonyl]-oxy]ethyl, 2-hydroxyl-3-phenoxypropyl, 3,5,5-trimethylhexyl, 3-(trimethyloxysilyl)propyl, 3-sulfopropyl, di(ethylene glycol)-2-ethylhexyl ether, dipentaerythritol penta-/hexa, ethyl 2-(trimethyl silylmethyl), ethyl-2-(trimethylsilylmethyl), alkylcyano, ethylene glycol dicyclopentenyl ether acrylates, acrylic acid, methacrylic acid, itaconic acid, fumaric acid, hydroxyethyl acrylate, hydroxylethyl methacrylate, acrylamide, methacrylamide, N-methylol(meth)acrylamide, acrylamidoacrylic acid, acrylamidoethyl(or propyl) methacrylate, 4-vinylpyridinium halide, and any monomer that contains urethane, amide, carbamate, carboxylate, carbonate, pyrimidone, urea, or isothiourea.

The monomers may be hydrophobic or hydrophilic, or a mixture of hydrophobic and hydrophilic monomers may be used.

Hydrophobic monomers that can be polymerized to form the latex particulate and the encapsulated pigment include, without limitation, styrene, p-methyl styrene, methyl methacrylate, hexyl acrylate, hexyl methacrylate, butyl acrylate, butyl methacrylate, ethyl acrylate, ethyl methacrylate, propyl acrylate, propyl methacrylate, octadecyl acrylate, octadecyl methacrylate, stearyl methacrylate, vinylbenzyl chloride, isobornyl acrylate, tetrahydrofurfuryl acrylate, 2-phenoxyethyl methacrylate, ethoxylated nonyl phenol methacrylate, isobornyl methacrylate, cyclohexyl methacrylate, t-butyl methacrylate, n-octyl methacrylate, lauryl methacrylate, trydecyl methacrylate, alkoxylated tetrahydrofurfuryl acrylate, isodecyl acrylate, isobornylmethacrylate, combinations thereof, derivatives thereof, and mixtures thereof.

Hydrophilic monomers may also, or alternatively, be present and can include, without limitation, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonoic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, aconitic acid, phenylacrylic acid, acryloxypropionic acid, vinylbenzoic acid, N-vinylsuccinamidic acid, mesaconic acid, methacroylalanine, acryloylhydroxyglycine, sulfoethyl methacrylic acid, sulfopropyl acrylic acid, sulfonic acid, styrene sulfonic acid, sulfoethylacrylic acid, 2-methacryloyloxymethane-1-sulfonic acid, 3-methacryoyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, vinyl benzoic acid, 2-acrylamido-2-methyl-1-propanesulfonic acid, 3-sulfopropyl methacrylate, copolymers of polyethylene glycols, poly(ethylene glycol), poly (propylene glycol), copolymers of ethylene glycol, copolymers of propylene glycol, formamides, N-vinyl fromamide, acrylamide, methacrylamide, N-vinyl pyrrolidone, water-soluble hydroxy-substituted acrylic or methacrylic esters, hydroxy ethylacrylate, 2-hydroxyethyl methacrylate, methoxypolyethylene glycol methacrylate, ethyltriethyleneglycol methacrylate, acrylamides, and mixtures thereof. In another example, the hydrophilic monomer can be an acidic monomer. As such, the acidic monomer can be selected from the group consisting of acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonoic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, aconitic acid, phenylacrylic acid, acryloxypropionic acid, vinylbenzoic acid, N-vinylsuccinamidic acid, mesaconic acid, methacroylalanine, acryloylhydroxyglycine, sulfoethyl methacrylic acid, sulfopropyl acrylic acid, sulfonic acid, styrene sulfonic acid, sulfoethylacrylic acid, 2-methacryloyloxymethane-1-sulfonic acid, 3-methacryoyloxypropane-1-sulfonic acid, 3-(vinyloxy)propane-1-sulfonic acid, ethylenesulfonic acid, vinyl sulfuric acid, 4-vinylphenyl sulfuric acid, ethylene phosphonic acid, vinyl phosphoric acid, vinyl benzoic acid, 2-acrylamido-2-methyl-1-propanesulfonic acid, combinations thereof, and derivatives thereof.

Cross-Linking Agents

Examples of polyfunctional cross-linking agents, by way of illustration and not limitation, include multifunctional acrylates such as diacrylates, triacrylates, tetraacrylates, and the like. In some examples, the multifunctional acrylates may include a portion or moiety that functions as a polymer precursor as described hereinbelow. Examples of multifunctional acrylate monomers or oligomers that may be employed as the polyfunctional cross-linking agent (some of which include a polymer precursor moiety) in the present examples, by way of illustration and not limitation, include diacrylates such as propoxylated neopentyl glycol diacrylate (available from Atofina Chemicals, Inc. (Philadelphia, Pa.) as Sartomer SR 9003), 1,6-hexanediol diacrylate (Sartomer SR 238 from Sartomer Company, Inc.(Exton, Pa.)), tripropylene glycol diacrylate, dipropylene glycol diacrylate, aliphatic diacrylate oligomer (CN 132 from Atofina), aliphatic urethane diacrylate (CN 981 from Atofina), and aromatic urethane diacrylate (CN 976 from Atofina), triacrylates or higher functionality monomers or oligomers such as amine modified polyether acrylates (available as PO 83 F, LR 8869, or LR 8889 from BASF Corporation), trimethylol propane triacrylate (Sartomer SR 351), tris-(2-hydroxyethyl) isocyanurate triacrylate (Sartomer SR 368), aromatic urethane triacrylate (CN 970 from Atofina), dipentaerythritol penta-/hexa-acrylate, pentaerythritol tetraacrylate (Sartomer SR 295), ethoxylated pentaerythritol tetraacrylate (Sartomer SR 494), and dipentaerythritol pentaacrylate (Sartomer SR 399), or mixtures of any of the foregoing. Additional examples of suitable cross-linking additives include chlorinated polyester acrylate (Sartomer CN 2100), amine modified epoxy acrylate (Sartomer CN 2100), aromatic urethane acrylate (Sartomer CN 2901), and polyurethane acrylate (Laromer LR 8949 from BASF). Other examples of polyfunctional cross-linking agents include end-capped acrylate moieties present on such oligomers as epoxy-acrylates, polyester-acrylates, acrylate oligomers, polyether acrylates, polyether-urethane acrylates, polyester-urethane acrylates, and polyurethanes end-capped with acrylate moieties such as hydroxyethyl acrylate. Further, the polyurethane oligomer can be prepared utilizing an aliphatic diisocyanate such as hexamethylene diisocyanate, cyclohexane diisocyanate, diisocyclohexy-lmethane diisocyanate, isophorone diisocyanate, for example. Other examples include, but are not limited to, isophorone diisocyanate, polyester polyurethane prepared from adipic acid and neopentyl glycol. Specific examples of polyfunctional cross-linking agents that include isocyanate functionalities and acrylate functionalities include materials sold by Sartomer Company such as CN966-H90, CN964, CN966, CN981, CN982, CN986, Pro1154, and CN301.

Initiator

The OPC overcoat formulation also includes an initiator. For example, the initiator may contain an oil-soluble initiator such as azobisisobutyronitrile (AIBN), azobis(cyclohexanecarbonitrile), benzoyl peroxide, or mixtures thereof. More generally, the initiator may be an organic peroxide, an azo compound or an inorganic peroxide.

Charge Transport Material (CTM)

Turning now to the novel alcohol-soluble charge transport materials (CTMs), in general, any alcohol-soluble CTMs can be used for the OPC coating. The hole transport polymers or oligomers contained in overcoat formulations can be, but are not limited to, semiconducting conjugated polymers, and could have, but are not limited to, a chemical structure shown in Scheme 1:

Scheme 1

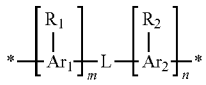

wherein, $Ar_1$ and $Ar_2$ are each independently aromatic ring moieties;

$R_1$ and $R_2$ are each independently C1 to C30 alkyl, C1 to C30 alkenyl, C1 to C30 alkynyl, C1 to C30 aryl, C1 to C30 alkoxy, C1 to C30 phenoxy, C1 to C30 thioalkyl, C1 to C30 thioaryl, C(O)OR4, N(R4)(R5), C(O)N(R4)(R5), F, Cl, Br, $NO_2$, CN, acyl, carboxylate or hydroxy, wherein R4 and R5 are each independently hydrogen, C1 to C30 alkyl, C1 to C30 aryl, or the like;

L is a linker that connects two aromatic rings, either nitrogen or a single bond; and m and n are integers independently between 0 and about 5,000, with the proviso that at least one of m or n is not 0.

The phrase "aromatic ring moiety" or "aromatic" as used herein includes monocyclic rings, bicyclic ring systems, and polycyclic ring systems, in which the monocyclic ring, or at least a portion of the bicyclic ring system or polycyclic ring system, is aromatic (exhibits, e.g., π-conjugation). The monocyclic rings, bicyclic ring systems, and polycyclic ring systems of the aromatic ring moiety may include carbocyclic rings and/or heterocyclic rings. The term "carbocyclic ring" denotes a ring in which each ring atom is carbon. The term "heterocyclic ring" denotes a ring in which at least one ring atom is not carbon and comprises 1 to 4 heteroatoms.

By way of example and not limitation, each of $Ar_1$ and $Ar_2$ may be independently phenyl, fluorenyl, biphenyl, terphenyl, tetraphenyl, naphthyl, anthryl, pyrenyl, phenanthryl, thiophenyl, pyrrolyl, furanyl, imidazolyl, triazolyl, isoxazolyl, oxazolyl, oxadiazolyl, furazanyl, pyridyl, bipyridyl, pyridazinyl, pyrimidyl, pyrazinyl, triazinyl, tetrazinyl, benzofuranyl, benzothiophenyl, indolyl, isoindazolyl, benzimidazolyl, benzotriazolyl, benzoxazolyl, quinolyl, isoquinolyl, cinnolyl, quinazolyl, naphthyridyl, phthalazyl, phentriazyl, benzotetrazyl, carbazolyl, dibenzofuranyl, dibenzothiophenyl, acridyl, or phenazyl. Suitable polar functional groups such as ammonium salts, phosphonium salts can be introduced to make those CTMs alcohol-soluble.

Alcohol

The alcohol employed in the dispersion mixture may be any alcohol that the POSS and hole transport materials are soluble in. Examples include, without limitation, methanol, ethanol, propanol, iso-propanol, methoxyethanol, butanol, tert-butanol, pentanol, hexanol, fluoro-ethanol, trifluoroethanol, 2,2,3,3,3-perfluoropropanol, heptafluoro-1-butanol, and hexafluoro-iso-propanol.

Formulation of OPC Coating Solutions

The solvent mixture may include at least one solvent in which the monomer(s) and dopant(s) are both soluble. Once the monomer(s) and dopant(s) are selected, then an appropriate solvent may be selected. Examples of monomer(s), dopant(s), and solvent(s) are shown in the above descriptions. Those are just some representative examples, and are not exhaustive of all possible combinations. Based on the teachings herein, a person of ordinary skill in the art can make appropriate selections of these components.

The solvent mixture may be applied to the charge transport layer 126 by any of spin-coating, roll-coating, dip coating, spray coating, roll-to-roll coating, or printing methods.

The solvent mixture on the charge transport layer 126 is polymerized by exposure to an elevated temperature in a range of about 50° to 100° C. and for a period of time in a range of about 1 to 10 hours to form the protective overcoat layer 128.

During curing to form the cross-linked polymer coating, the POSS molecules retain their polyhedral structure and, because of the polymerizable functional groups, are connected to other POSS units and/or monomers. The reaction results in a cross-linked polyacrylate that has POSS moieties interconnected with each other and with acrylate moieties, with the charge transport material dispersed in the cross-linked polymer.

EXAMPLES

Figure 2:
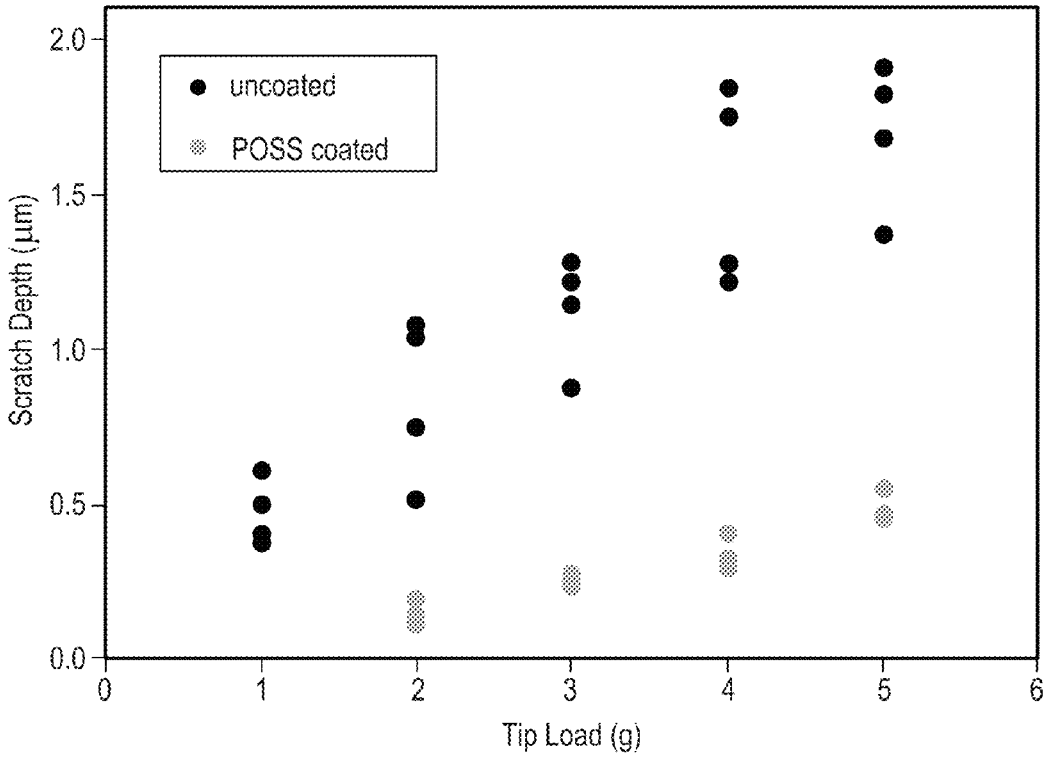
FIG. 2, on coordinates of scratch depth (in μm) and tip load (in grams), is a plot of scratch depth as measured with a Dektak profiler of an uncoated OPC surface and an OPC surface coated with a protective layer of a POSS-based coating.

The following examples demonstrate applicability of the afore-described materials for forming the protective coating 128 on an OPC:

Scratch Depth Measurement:

Controlled scratching of the OPC coating 128 may provide information the ability of a coated material to resist scratches during the printing process. This measurement was done using a Taber scratch tester which applies a controlled force (load) on a diamond tip pressing against the tested surface, while this surface is in a constant rotary motion. This test is applied for a defined time period (1 minute) and then scratch depth is measured with Dektak profiler. FIG. 2 demonstrates improvement in scratch resistance when the OPC surface is coated with a protective thin layer of a POSS-based coating mixture described above. The limit layer thickness was about 5 to 10 micron and it resulted in a solid layer coating (after solvent evaporated) of about 500 nm. The composition included POSS in which all R and X groups were methacrylate groups, azobisisobutyronitrile (AIBN—an initiator), a CTM that was an alcohol-soluble polyfluorene-based copolymer, and a mixture of iso-propanol and hexafluoro-iso-propanol.

Figure 3:
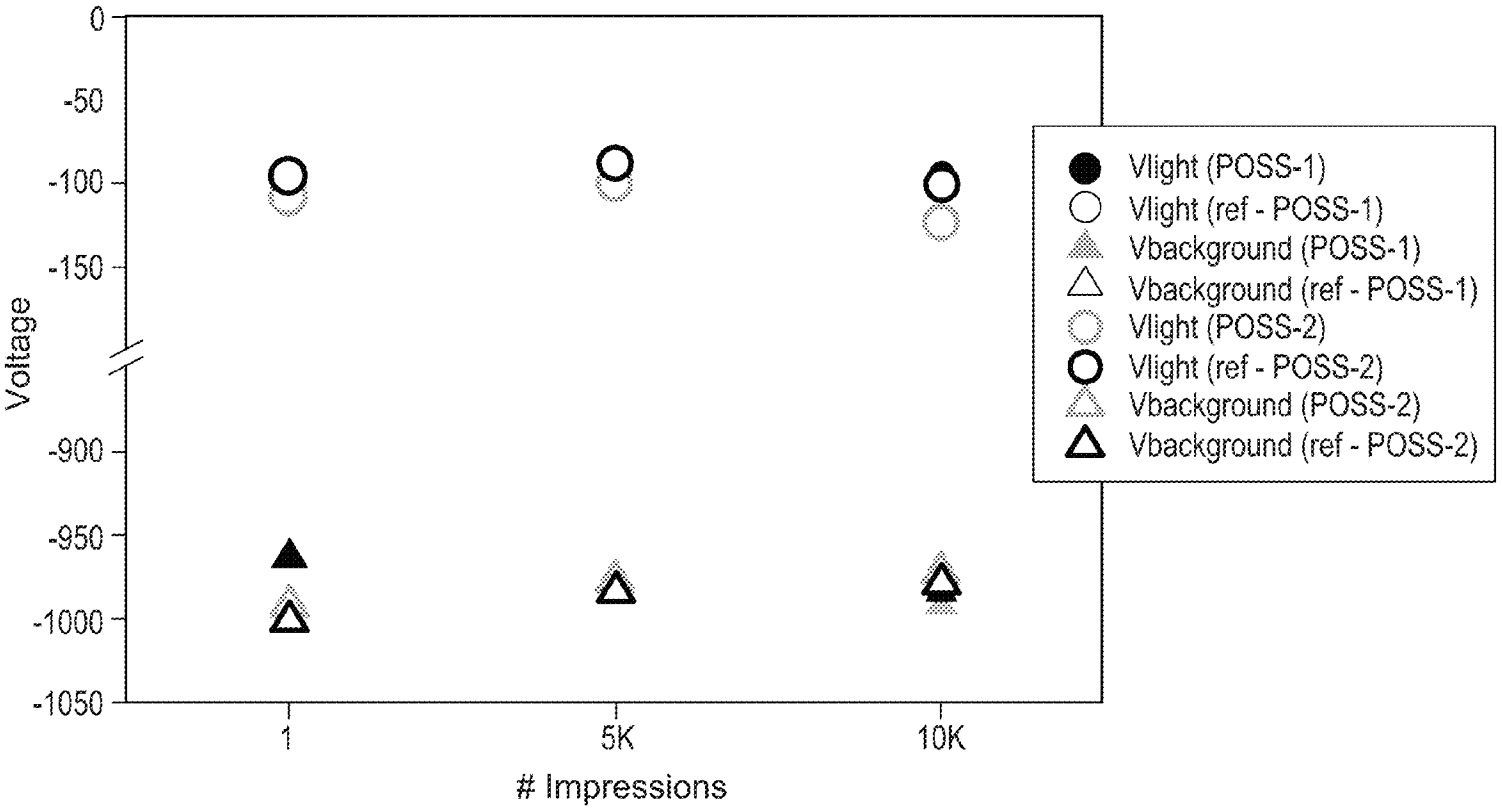
FIG. 3, on coordinates of voltage (in V) and number of impressions, is a plot of $V_{light}$ and $V_{background}$ for up to 10,000 impressions for two different POSS-based formulations.

$V_{light}$ and $V_{background}$—Comparison with Uncoated OPC (Reference):

FIG. 3 compares $V_{light}$ and $V_{background}$ for up to 10K impressions for two different POSS-based formulations showing that application of POSS coating does not degrade the most important electrical parameters of the photoconductor, namely $V_{light}$ and $V_{background}$.

Figure 4A:
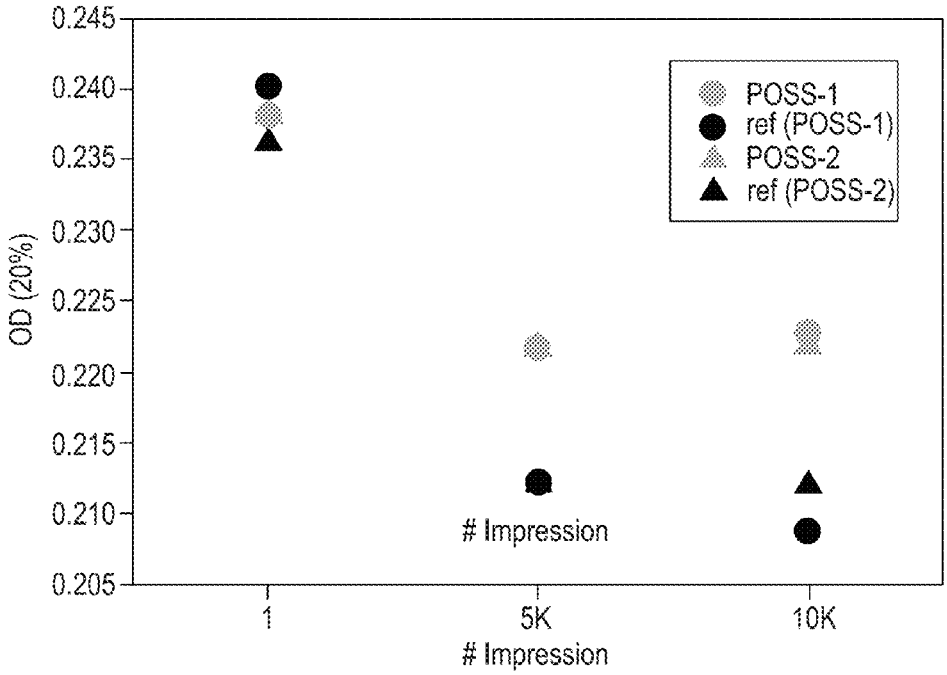
FIGS. 4A and 4B, on coordinates of optical density (OD) and number of impressions, provide a comparison of OD measured for nominal 20% (FIG. 4A) and 80% (FIG. 4B) black ink coverage.
Figure 4B:
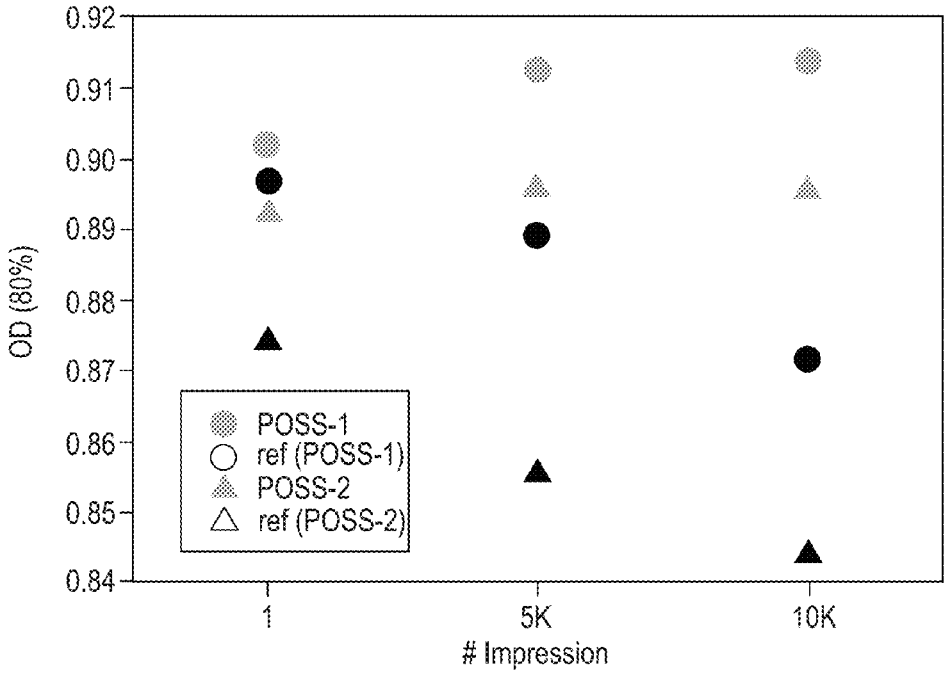

Optical Density (OD) Measurement:

FIGS. 4A and 4B compare OD measured for nominal 20% black ink coverage (FIG. 4A) and 80% black ink coverage (FIG. 4B). As in the case of $V_{light}$ and $V_{background}$ coated and uncoated, no OD degradation can be seen as a result of POSS coating.

Figure 5A:
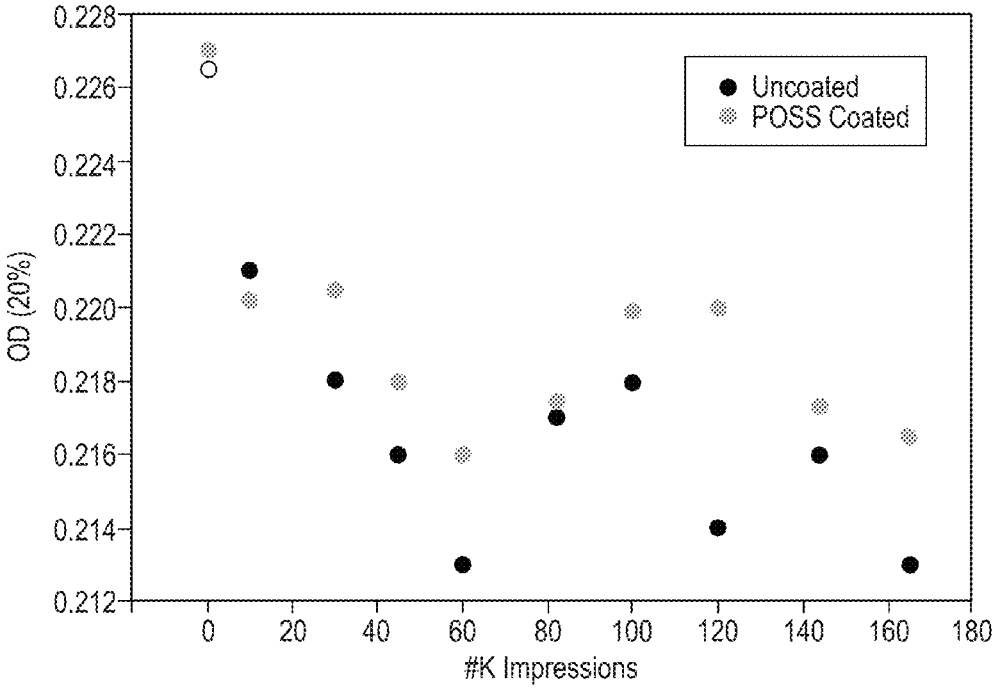
FIGS. 5A and 5B, on coordinates of optical density and number of impressions, provide a comparison of OD measured for nominal 20% (FIG. 5A) and 80% (FIG. 5B) black ink coverage throughout an extended printing run.
Figure 5B:
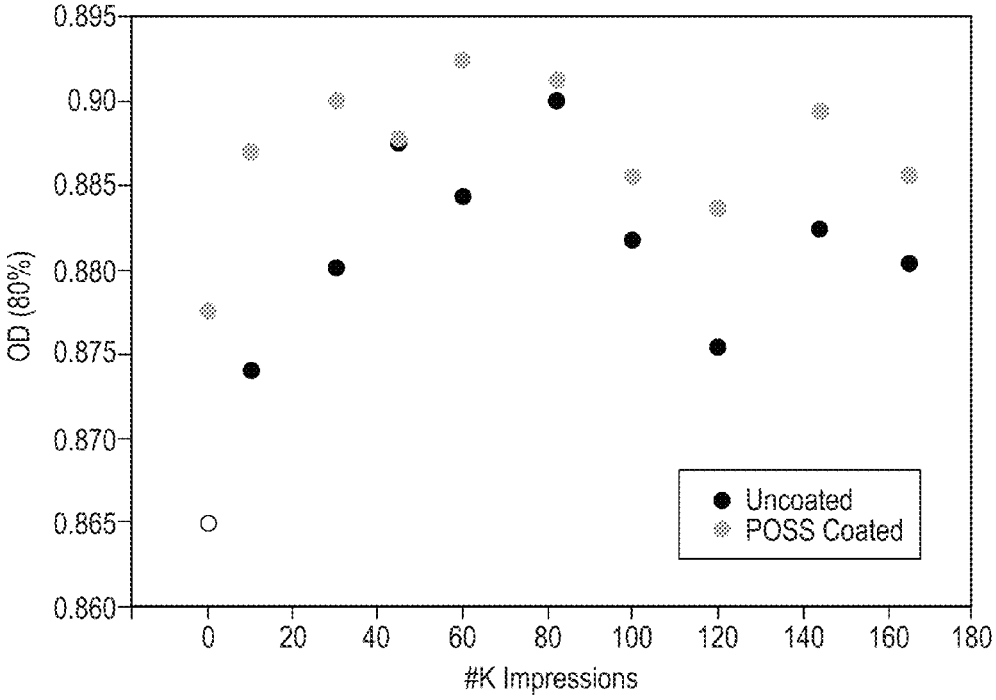

OD Extended Printing:

FIGS. 5A-5B show OD measurements throughout an extended printing run. It shows that a POSS-coated OPC retains the desired OD at least as good as uncoated material for both 20% nominal ink coverage (FIG. 5A) and 80% nominal ink coverage (FIG. 5B). Some improvement (better retaining the desired OD) can be seen for the POSS-coated material after 150K impressions. This demonstrates advantageous role that the POSS coating may play in the liquid electrophotographic (LEP) printing technology.

In summary, this disclosure provides a new cross-linkable system—polyhedral oligomeric silsesquioxanes (POSS) based cross-linkers doped with suitable charge transport materials (CTMs)—that can be used for alcohol-based solution OPC coating processes. Due to its true and intrinsic hybrid character and versatile choices of groups R that are covalently bonded with its inorganic core, these POSS-based OPC overcoat formulations offer several advantages: a) this formulation avoids the use of expensive fluorinated alcohols, which may cause damages to the existing OPC surfaces; b) the film based on POSS crosslinker has excellent chemical stability and is stable against a wide range of chemicals; c) the film has excellent mechanical strength against scratch; and d) the film has very strong water resistance.

What is claimed is:

1. An organic photoconductor including:

a conductive substrate;

a charge generation layer over the conductive substrate;

a charge transport layer over the charge generation layer; and an overcoat layer over the charge transport layer, wherein the overcoat layer comprises a cross-linked polyacrylate that includes polyhedral oligomeric silsesquioxane moieties interconnected with each other and with acrylate moieties and a charge transport material dispersed in the cross-linked polyacrylate.

2. The organic photoconductor of claim 1 wherein the charge transport layer is formed from a dispersion comprising the polyhedral oligomeric silsesquioxane, a cross-linkable monomer, oligomer or polymer, a cross-linking agent, an initiator, the charge transport material, and an alcohol-based solvent.

3. The organic photoconductor of claim 2 wherein the dispersion further includes a surfactant.

4. The organic photoconductor of claim 3 wherein the overcoat layer is formed from a dispersion comprising:

1 to 20 wt % polyhedral silsesquioxane (POSS);

1 to 20 wt % co-monomer;

1 to 15 wt % cross-linking agent;

0.1 to 5 wt % initiator;

0 to 10 wt % surfactant;

0.1 to 5 wt % charge transport material; and the balance an alcohol or a mixture of different alcohols.

5. The organic photoconductor of claim 2 wherein the polyhedral oligomeric silsesquioxane has a polyhedral cage structure

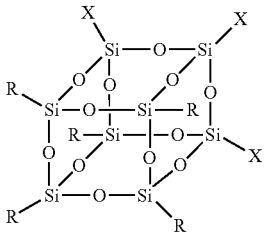

where R is selected from the group consisting of alkyl, cycloalkyl, and aryl groups, and X is a polymerizable functional group.

6. The organic photoconductor of claim 5 wherein R is selected from the group consisting of methyl, ethyl, propyl, iso-propyl, butyl, sec-butyl, tert-butyl, gently, hexyl, cyclopropyl, cyclobutyl, cyclopentyl, cyclohexyl, cyclopentyl, phenyl, substituted phenyl, benzyl, and substituted benzyl, and X is selected from the group consisting of vinyls, acrylates, methacrylates, epoxies, trialkoxysilanes, trichlorosilanes, and isocyanates.

7. The organic photoconductor of claim 2 wherein the cross-linkable monomer, oligomer, or polymer is selected from the group consisting of styrenes, C1 to C8 alkyl methacrylates, C1 to C8 alkyl acrylates, ethylene glycol methacrylates, ethylene glycol dimethacrylates, methacrylic acids, and acrylic acids.

8. The organic photoconductor of claim 2 wherein the cross-linking agent is a multifunctional acrylate selected from the group consisting of diacrylates, triacrylates, and tetraacrylates.

9. The organic photoconductor of claim 2 wherein the initiator is selected from the group consisting of organic peroxides, azo compounds and inorganic peroxides.

10. The organic photoconductor of claim 2 wherein the charge transport material comprises:

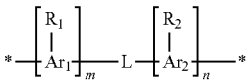

wherein, $Ar_1$ and $Ar_2$ are each independently aromatic ring moieties;

$R_1$ and $R_2$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, C(O)OR4, $N(R_4)(R_5)$, $C(O)N(R_4)(R_5)$, F, Cl, Br, $NO_2$, CN, acyl, carboxylate and hydroxy, wherein $R_4$ and $R_5$ are each independently selected from hydrogen and C1-C30 alkyl;

L is a linker that connects the two aromatic rings; and the letters m and n are integers independently between 0 and about 5,000 with the proviso that at least one of m or n is not 0.

11. The organic photoconductor of claim 10 wherein $Ar_1$ and $Ar_2$ are independently selected from the group consisting of phenyl, fluorenyl, biphenyl, terphenyl, tetraphenyl, naphthyl, anthryl, pyrenyl, phenanthryl, thiophenyl, pyrrolyl, furanyl, imidazolyl, triazolyl, isoxazolyl, oxazolyl, oxadiazolyl, furazanyl, pyridyl, bipyridyl, pyridazinyl, pyrimidyl, pyrazinyl, triazinyl, tetrazinyl, benzofuranyl, benzothiophenyl, indolyl, isoindazolyl, benzimidazolyl, benzotriazolyl, benzoxazolyl, quinolyl, isoquinolyl, cinnolyl, quinazolyl, naphthyridyl, phthalazyl, phentriazyl, benzotetrazyl, carbazolyl, dibenzofuranyl, dibenzothiophenyl, acridyl, and phenazyl.

12. The organic photoconductor of claim 10 wherein L is either nitrogen or a single bond.

13. A process for manufacturing the organic photoconductor of claim 1 with a protective coating formed thereon, the organic photoconductor including the charge generation layer for generating charges and the outer charge transport layer on the charge generation layer, the charge transport layer for facilitating charge movement, the process comprising:

combining and mixing together charge transport materials with a cross-linkable formulation that includes a cross-linkable monomer, oligomer, or polymer; a cross-linking agent, an initiator, and a polyhedral oligomeric silsesquioxane, in an alcohol-based solvent to form a dispersion mixture;

applying the dispersion mixture to the surface of the organic photoconductor to form the overcoat layer thereon; and subjecting the overcoat layer to thermal treatment to form a polymerized layer.

14. The process of claim 13 wherein the charge transport layer is formed from a dispersion comprising the polyhedral oligomeric silsesquioxane, a cross-linkable monomer, oligomer or polymer, a cross-linking agent, an initiator, the charge transport material, and an alcohol-based solvent.

15. The process of claim 14 wherein the following components are mixed in the concentrations given to form the solution:

1 to 20 wt % polyhedral silsesquioxane (POSS);

1 to 20 wt % co-monomer;

1 to 15 wt % cross-linking agent;

0.1 to 5 wt % initiator;

0 to 10 wt % surfactant;

0.1 to 5 wt % charge transport material; and the balance an alcohol or a mixture of different alcohols.

16. The process of claim 14 wherein the polyhedral oligomeric silsesquioxanes has a polyhedral cage structure

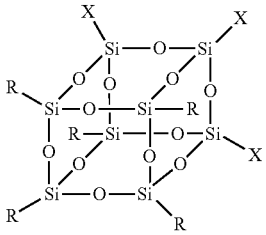

where R is selected from the group consisting of alkyl, cycloalkyl, and aryl groups, and X is a polymerizable functional group.

17. The process of claim 14 wherein the charge transport material comprises:

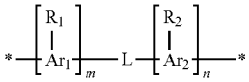

wherein, $Ar_1$ and $Ar_2$ are each independently aromatic ring moieties;

$R_1$ and $R_2$ are each independently selected from the group consisting of C1-C30 alkyl, C1-C30 alkenyl, C1-C30 alkynyl, C1-C30 aryl, C1-C30 alkoxy, C1-C30 phenoxy, C1-C30 thioalkyl, C1-C30 thioaryl, C(O)OR4, $N(R_4)(R_5)$, $C(O)N(R_4)(R_5)$, F, Cl, Br, $NO_2$, CN, acyl, carboxylate and hydroxy, wherein $R_4$ and $R_5$ are each independently selected from hydrogen and C1-C30 alkyl;

L is a linker that connects the two aromatic rings; and the letters m and n are integers independently between 0 and about 5,000 with the proviso that at least one of m or n is not 0.

18. The process of claim 13 wherein the mixture is applied to the charge generation layer by any of spin-coating, roll-coating, dip coating, spray coating, roll-to-roll coating, or printing methods.

19. The process of claim 13 wherein the mixture on the charge transport layer is polymerized by exposure to an elevated temperature in a range of about 50° to 100° C. and for a period of time in a range of about 1 to 10 hours.

20. A coating for an organic photoconductor, the coating comprising a cross-linked polyacrylate that includes polyhedral oligomeric silsesquioxane moieties interconnected with each other and with acrylate moieties and a charge transport material dispersed in the cross-linked polyacrylate.

* * * * *

UNITED STATES PATENT AND TRADEMARK OFFICE

CERTIFICATE OF CORRECTION

PATENT NO. : 8,980,511 B2
APPLICATION NO. : 13/672503
DATED : March 17, 2015
INVENTOR(S) : Zhang-Lin Zhou et al.

It is certified that error appears in the above-identified patent and that said Letters Patent is hereby corrected as shown below:

In the Claims

In column 14, line 65, in Claim 6, delete “gently” and insert -- pentyl --, therefor.

Signed and Sealed this
Eighteenth Day of August, 2015

Michelle K. Lee

Michelle K. Lee
*Director of the United States Patent and Trademark Office*